US005090535A

United States Patent [19]

Schiel et al.

[11] Patent Number: 5,090,535

[45] Date of Patent: Feb. 25, 1992

[54] DRIVE UNIT PARTICULARLY FOR THE CALENDER OF A PAPER MACHINE

[75] Inventors: Christian Schiel; Walter Reiter, both of Heidenheim, Fed. Rep. of Germany

[73] Assignee: J.M. Voith GmbH, Heidenheim, Fed. Rep. of Germany

[21] Appl. No.: 676,875

[22] Filed: Mar. 28, 1991

[30] Foreign Application Priority Data

Apr. 6, 1990 [DE] Fed. Rep. of Germany ..... 4011143

[51] Int. Cl.[5] ..... F16D 11/04

[52] U.S. Cl. ..... 192/67 R; 464/136

[58] Field of Search ..... 192/67 R, 114 R; 464/136, 117

[56] References Cited

U.S. PATENT DOCUMENTS

| | | | |
|---|---|---|---|
| 2,618,941 | 11/1952 | Iversen | 64/7 |
| 2,761,299 | 9/1956 | Huddle | 192/67 R X |
| 2,845,781 | 8/1958 | O'Brien | 64/9 |
| 2,911,804 | 11/1959 | O'Brien | 64/7 |
| 4,194,279 | 3/1980 | Haslhofer | 29/281.5 |
| 4,924,717 | 5/1990 | Aimo | 192/114 R X |
| 4,997,072 | 3/1991 | Lapthorne | 192/67 R |
| 5,031,740 | 7/1991 | Deichstetter et al. | 192/67 R X |

FOREIGN PATENT DOCUMENTS

| | | | |
|---|---|---|---|
| 1283784 | 11/1968 | Fed. Rep. of Germany . | |
| 2058008 | 10/1971 | Fed. Rep. of Germany . | |
| 2362524 | 6/1975 | Fed. Rep. of Germany . | |
| 2734381 | 2/1979 | Fed. Rep. of Germany . | |
| 57-140918 | 8/1982 | Japan | 192/114 R |
| 1529805 | 10/1978 | United Kingdom . | |

*Primary Examiner*—Leslie A. Braun
*Assistant Examiner*—Andrea Pitts
*Attorney, Agent, or Firm*—Baker & Daniels

[57] ABSTRACT

The invention concerns a drive unit, particularly for a calender of a paper machine, with a universal joint featuring two joint forms as well as a crosshead, with a shaft each coordinated with the two joint forks, one shaft being arranged on the drive side and the other on the output side (drive shaft and output shaft), additionally, with a clutch for engaging and disengaging the drive unit. The invention is characterized by the following characteristics:

(a) The clutch is fashioned as a gear clutch with a number of teeth extending in axial direction and coordinated each with one of the clutch halves;

(b) for actuation of the clutch there is a shift mechanism provided;

(c) coordinated with the universal joint is a guide device, for instance a cylindrical sleeve, for guiding the universal joint along with the extendable clutch half on its shift path in the clutch process.

11 Claims, 3 Drawing Sheets

DRIVE UNIT PARTICULARLY FOR THE CALENDER OF A PAPER MACHINE

BACKGROUND OF THE INVENTION

The invention concerns a drive unit, particularly for a calender of a paper machine, with a universal joint featuring two joint forks as well as a crosshead. A shaft is coordinated with each of the two joint forks. One shaft is arranged on the drive side and the other on the output side (drive shaft and output shaft). Additionally, a clutch engages and disengages the drive unit. Such drive units have become known from the German patent disclosure 27 34 381. Similar units are known from the U.S. Pat. Nos. 2,618,941, 2,845,781, 2,911,804, and 4,194,279.

Today, such drive units must not only meet the demand for absolute operational safety, but also for the possibility of automating the clutch contained in them. The known drive units do not meet these desires in optimal fashion.

The problem underlying the invention is to design a drive unit according to the categorial definition that will be simple in construction, low cost in manufacture, reliable in operation and automatable as regards its actuation.

SUMMARY OF THE INVENTION

This problem is solved according to the features of the present invention. The clutch is designed as a gear clutch with a number of teeth extending in axial direction and coordinated each with a clutch half. A shift mechanism which attaches directly or indirectly to the universal joint is provided for actuation of the clutch. A guide device coordinated with the universal joint is provided for guiding the universal joint along with the extendable clutch half on its shift path in the clutch operation. The guide device, for instance, may comprise a cylindrical sleeve.

DESCRIPTION OF THE PREFERRED EMBODIMENT

Figure 1:
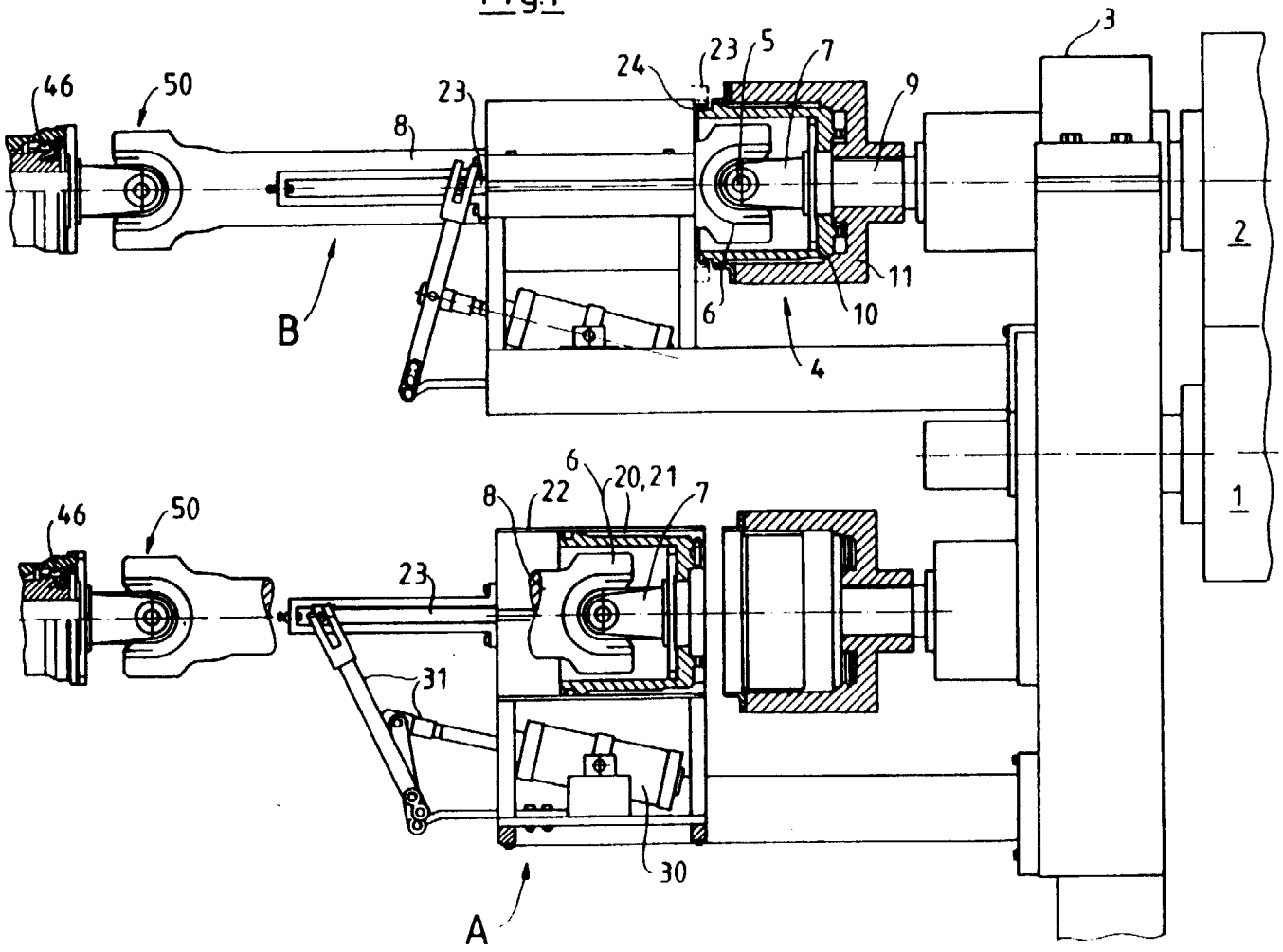
FIG. 1 shows the presently essential components of two inventional drive units for the calender of a paper machine, in front elevation.

The two drive units illustrated in FIG. 1 are coordinated with two rolls of a calender. The rolls 1 and 2 are so mounted in uprights 3 that their mutual, axially vertical spacing can be varied by up to about 60 mm as the calender is opened, i.e., in the radial retraction of the two rolls 1 and 2.

Coordinated with the lower roll 1 is the drive unit A. Coordinated with the upper roll 2 is the drive unit B. For clarification of the working principle of the two inventional drive units A, B, the clutch in the drive unit A is illustrated in extended position and that of the drive unit B in retracted position. In both cases, a motor and, as the case may be, a transmission, each which in the illustration should be located at the left, have been omitted.

The two drive units each include a universal joint 4 consisting of a crosshead 5 and two joint forks 6, 7. The two joint forks 6, 7 are each coordinated with shafts. Joint fork 6 is coordinated with a drive shaft 8, and joint fork 7 is coordinated with output shaft 9.

The clutch comprises two clutch halves 10, 11. These are cup-shaped in design, and are aligned in such a way that the clutch half 10 can be inserted in the clutch half 11, so that of these cups will in engaged position be very close to each other or even touch.

According to the invention, the clutch is designed as a direction and are coordinated with the two clutch halves. Moreover, this clutch—again in the illustrated embodiment—is coordinated with the output shaft 9. Lastly, the other shaft, namely the shaft 8, is of a telescope type design.

Due to the telescope type extendable design, the length of possible to engage or disengage the clutch. When the drive shaft 8 is "shortened" by telescoping, the crosshead 5 moves into the position which it assumes in the drive unit A. In this shift movement it runs, for example, in a cylindrical sleeve 22.

Figure 2:
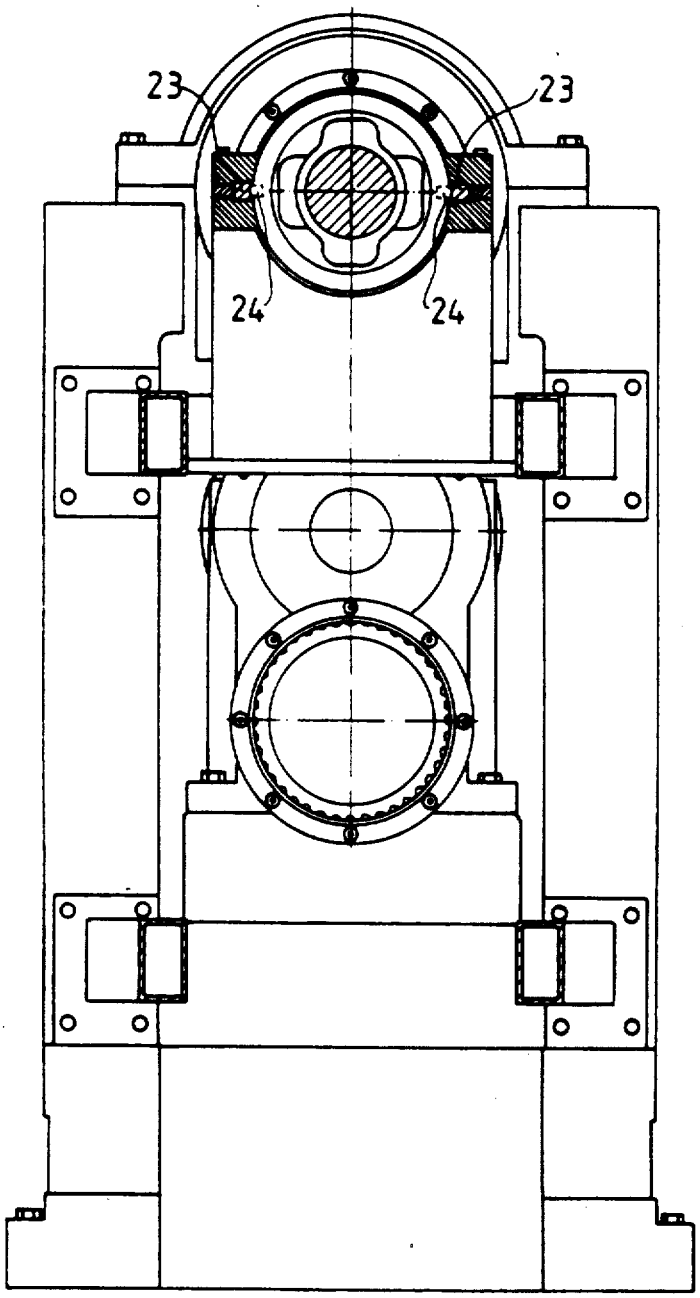
FIG. 2, shows the object of FIG. 1 viewed in axial direction, from the drive side.

Also evident from FIG. 1 and FIG. 2 are particular views of a shift mechanism for actuation of the clutch. The mechanism encompasses a pneumatic unit which by way of a linkage 31 and at least two slides 23 running linearly in the sleeve 22 attaches to the claws 24 on the inside part of the clutch in order to engage or disengage that part.

Figure 3:
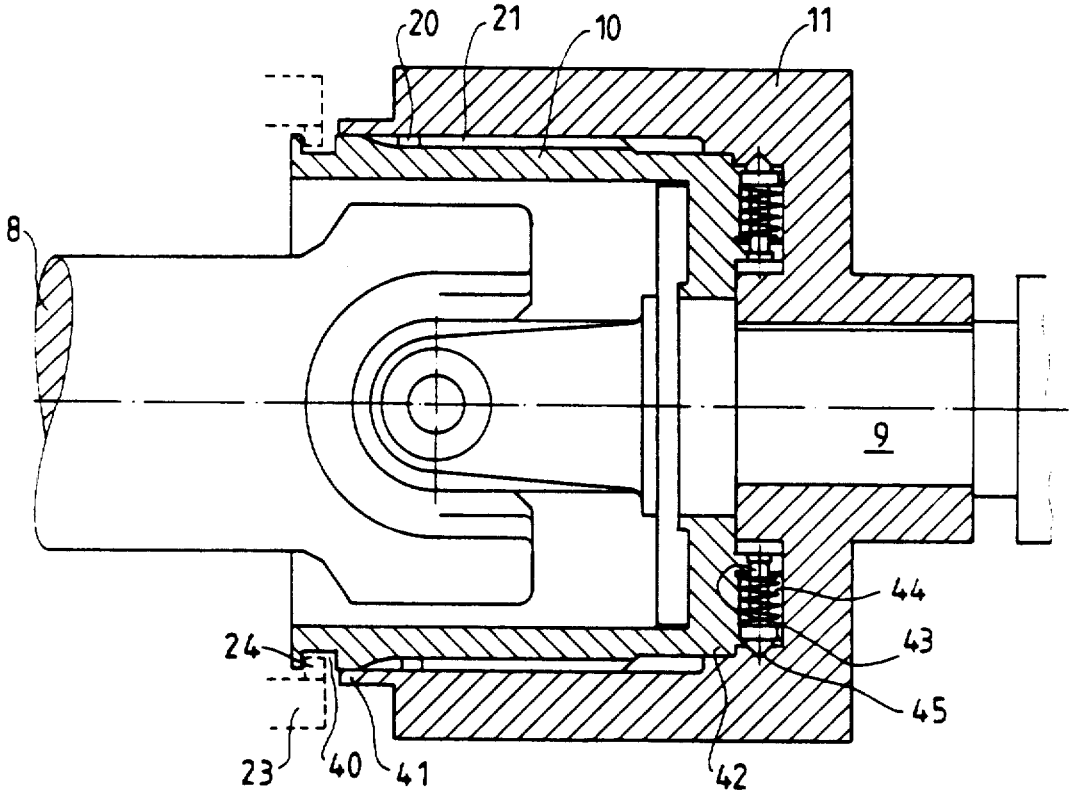
FIG. 3, scaled up, shows the universal joint with the inventional clutch from the object of FIGS. 1 and 2.

FIG. 3 illustrates in greater detail certain features of the inventional clutch with the universal joint. The clutch half 10 features an annular groove 40 which is engaged by one or more drive claws 24 in order to shift the clutch half 10 in the desired direction. In one embodiment of the invention, the inside width of the groove 40 is dimensioned greater than the axial expanse of the drive claws 24. The idea behind it is this: The clutch half rotates during operation, whereas the drive claws 24 are fixed. If, upon engagement of the clutch, the claws are adjusted to a center position in the groove, so that they will not make contact with the flanks on the groove, a wear on these parts is avoided. Naturally, the parts also should be so designed that the radially inner faces of the claws 24 will not touch the bottom of the groove.

The pneumatic unit can be remotely operated by button depression, which solves an important partial problem of the invention.

Evident in FIG. 3 are additionally collars 41 and 42 that assure a clean, concentric guidance of the clutch half 10 in the clutch half 11. In order to keep the two clutch halves 10, 11 in engaged state there are pins 43 provided which are radially arranged. These can engage in radial direction, under the effect of springs 44, a radial groove 45.

In the illustrated embodiment, the drive shaft 8 was given a telescope type design in order to achieve the necessary engagement and disengagement movement of the clutch 10, 11. Instead, there are also other options that fall as well within the scope of the invention and where the drive shaft is not a telescoping type.

In a first variant, for instance, the entire drive of the respective drive unit, that is, for instance A or B or both drive units, can be made shiftable, and at that, together with the follow-on components, namely presently a first universal joint 50, the subsequent drive shaft 8, the second universal joint 4 and the clutch half 10 connected with this universal joint.

According to a second variant, the drive of the respective drive unit is stationary. The first universal joint 50 and the drive shaft 8 with the second universal joint 4 and clutch half 10 are axially shiftable for engagement and disengagement of the clutch 10, 11. To enable the performance of the shift movement, the journal 46 of the drive unit features a hypoid gear clutch with a sufficiently large axial stroke.

According to a third variant, the first universal joint 50 is equipped with a parallel gear clutch that permits an axial shifting at this point. Here as well, the shaft 8 need not be telescopable.

It will be appreciated that the foregoing is presented by way of illustration only, and not by way of any limitation, and that various alternatives and modifications may be made to the illustrated embodiment without departing from the spirit and scope of the invention.

What is claimed is:

1. A drive unit for a calender, said drive unit having a drive end and an output end, comprising:

a first universal joint;

a second universal joint, said second universal joint comprising a pair of joint halves;

a pair of shafts, each of said shafts being coordinated with a separate one of said joint halves, wherein one of said shafts comprises a drive shaft and is arranged on the drive end of the drive unit, and the other of said shafts comprises an output shaft and is arranged on the output end of the drive unit, said drive shaft being connected at one end to a primary shaft through said first universal joint, said drive shaft being connected at the other end to said output shaft through said second universal joint;

a clutch for engaging and disengaging said drive unit, said clutch comprising two generally cup-shaped clutch halves, a first one of said clutch halves being extendable along a shift path; said clutch halves being sized and arranged to be nested one within the other when said unit is in the engaged condition, whereby said bottom portions of said cup-shaped halves are situated in one of closely spaced and toughing relationship with each other; each of said clutch halves having a sidewall, and having teeth extending in the axial direction of said clutch halves generally across said sidewall;

a shift mechanism operably associated with said second universal joint for actuating said clutch; and guide means coordinated with said second universal joint for guiding said joint along with said extendable clutch half on said shift path during operation of said clutch.

2. A drive unit according to claim 1, in which said cup-shaped clutch halves have respective collars, said collars being structured and arranged for enabling a smooth concentric guidance of said halves.

3. A drive unit according to claim 2, wherein said collars comprise an oil seal.

4. A drive unit according to claim 1, wherein said guide means comprises a cylindrical sleeve.

5. A drive unit according to claim 1, wherein said first clutch half is situated so that it borders directly on said joint half coordinated with the output shaft.

6. A drive unit according to claim 1, further including one or more drive claws coordinated with said shift mechanism, wherein said drive claws engage a peripheral groove disposed in said first clutch half.

7. A drive unit according to claim 6, in which said drive claws have an axial expanse and said groove has flanks, wherein said claws assume a center position in said groove upon engagement of the clutch, said groove being wider than said axial expanse so that said drive claws will not make contact with said flanks of the groove as said claws assume said center position.

8. A drive unit according to claim 1, including means for axially retaining said clutch halves in an engaged state.

9. A drive unit according to claim 8, wherein said means for axially retaining said clutch halves comprises one or more radial pins, springs means for forcing the pins radially outward, and a peripheral groove for receiving an end of said pins.

10. A drive unit according to claim 1, including means for mutually centering said two clutch halves.

11. A drive unit according to claim 10, in which the teeth of one of said clutch halves have respective ends that face the respective ends of the teeth of the other of said clutch halves, wherein the teeth of one clutch half interact with the teeth of the other clutch half, said teeth having a scarfed-shape for cutting on said facing ends for purposes of easier threading.

* * * * *